US008403450B2

(12) United States Patent
Sato et al.

(10) Patent No.: US 8,403,450 B2
(45) Date of Patent: Mar. 26, 2013

(54) LIQUID EJECTION HEAD WITH NOZZLE PLATE HEATER

(75) Inventors: Masahiko Sato, Shiojiri (JP); Hiroyuki Hagiwara, Matsumoto (JP); Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 13/081,198

(22) Filed: Apr. 6, 2011

(65) Prior Publication Data

US 2011/0316935 A1 Dec. 29, 2011

(30) Foreign Application Priority Data

Jun. 29, 2010 (JP) ..... 2010-147248

(51) Int. Cl.
*B41J 29/38* (2006.01)

(52) U.S. Cl. ..... 347/17; 347/70; 347/58; 347/14

(58) Field of Classification Search ..... 347/14, 347/17, 20, 23, 66, 68, 70–71, 62
See application file for complete search history.

(56) References Cited

U.S. PATENT DOCUMENTS 6,386,672 B1 * 5/2002 Kimura et al. ..... 347/18
2008/0297553 A1 12/2008 Nagate
2009/0251505 A1 * 10/2009 Arimura ..... 347/17

FOREIGN PATENT DOCUMENTS

JP 2008-296498 A 12/2008

* cited by examiner

*Primary Examiner* — Juanita D Jackson
(74) *Attorney, Agent, or Firm* — Kilpatrick Townsend & Stockton LLP

(57) ABSTRACT

A liquid ejection head including: a flow channel unit including a nozzle plate, and a flow-channel-containing substrate (FCC), the nozzle plate and the FCC being laminated, a head case formed with a common liquid flow channel configured to supply the liquid to the reservoir and joined to the FCC on the side opposite from the nozzle plate; a heater configured to heat the nozzle plate; a head cover heated by the heater and formed with a bottom surface portion opposing the nozzle plate on the side opposite from the head case, wherein a distal end of the head cover comes into abutment with a portion between an area of the nozzle plate corresponding to the reservoir and an area formed with the nozzle row, and a void is formed between the area of the nozzle plate corresponding to the reservoir and the head cover.

3 Claims, 7 Drawing Sheets

LIQUID EJECTION HEAD WITH NOZZLE PLATE HEATER

The entire disclosure of Japanese Patent Application No: 2010-147248, filed Jun. 29, 2010 are expressly incorporated by reference herein.

BACKGROUND

1. Technical Field

The present invention relates to a liquid ejection head such as an ink jet recording head which applies pressure variations to a pressure chamber communicating with nozzles to eject liquid in the pressure chamber from the nozzles.

2. Related Art

Liquid ejection heads configured to eject liquid in a pressure chamber from nozzles as liquid droplets by generating pressure variations include, for example, an ink jet recording head (hereinafter referred to simply as "recording head") used in an image recording apparatus such as ink jet recording apparatuses (hereinafter, referred to simply as "printer"), coloring material ejection heads used for manufacturing color filters used in liquid crystal displays, electrode material ejection heads used for forming electrodes for organic EL (Electro Luminescence) displays and FEDs (surface emission-type display), and biological organic substance ejection heads used for manufacturing biochips.

For example, the recording head described above is configured by attaching a flow channel unit formed with a consecutive liquid flow channel from a reservoir via the pressure chamber to the nozzles or an actuator unit having a pressure generating element which is capable of varying the volume of the pressure chamber to a resin-made head case. The above-described flow channel unit includes a metallic nozzle plate having a plurality of nozzles joined thereto.

Liquid to be ejected from the recording head as described above has a viscosity suitable for ejection such as 4 mPa·s at normal temperatures according to the type of the liquid. The viscosity of the liquid has a correlation with the temperature. Therefore, the liquid increases in viscosity with decrease in temperature, and decreases in viscosity with increase in temperature. Therefore, in order to maintain the viscosity of the liquid to be ejected from the respective nozzles to a viscosity suitable for ejection, a configuration including a heating layer for heating the liquid provided right below the reservoir in the flow channel unit, and a heat-insulating layer provided below the heating layer is proposed (see JP-A-2008-296498).

However, since the heating layer is provided right below the reservoir, the heat added to the liquid in the reservoir is radiated in the liquid flow channel extending to the nozzles, so that the temperature of the liquid might be lowered before being ejected from the nozzles. In other words, a set temperature of the heating layer is diverged from the temperature of the liquid at the nozzles, so that there is a possibility that the viscosity of the liquid cannot be adjusted adequately.

SUMMARY

In view of such circumstances, it is an object of the invention to provide a liquid ejection head configured to prevent heat dissipation from a liquid flow channel and adjust the viscosity of liquid to be ejected by efficiently heating the vicinity of the nozzle, thereby ensuring high reliability.

There is provided a liquid ejection head including: a flow channel unit including a nozzle plate provided with nozzle rows formed of a plurality of nozzles, and a flow-channel-containing substrate having pressure chambers communicating with the nozzles and a reservoir configured to supply liquid into the pressure chambers and formed on the side of a side surface of the nozzle plate with respect to the nozzle row, the nozzle plate and the flow-channel-containing substrate being laminated, a head case formed with a common liquid flow channel configured to supply the liquid to the reservoir and joined to the flow-channel-containing substrate on the side opposite from the nozzle plate; a heater configured to heat the nozzle plate; a head cover heated by the heater and formed with a bottom surface portion opposing the nozzle plate on the side opposite from the head case, wherein a distal end of the head cover comes into abutment with a portion between an area of the nozzle plate corresponding to the reservoir and an area formed with the nozzle row, and a void is formed between the area of the nozzle plate corresponding to the reservoir and the head cover.

In this configuration, the liquid ejecting head includes the heater mounted on a side surface of the head case, and the head cover including a side surface portion which comes into abutment with the heater at least partly and a bottom surface portion continued from the side surface portion, bent toward the nozzle plate, and opposing the nozzle plate on the side opposite from the head case, and covering a peripheral edge of the flow channel unit. The bottom surface portion is formed with a window portion so as to expose the nozzles of the nozzle plate. The distal end of the opening edge of the window portion comes into abutment with the nozzle plate at a portion between the area corresponding to the reservoir and the nozzles. The void is formed between the nozzle plate and the bottom surface portion, and in an area corresponding to the reservoir. Therefore, the liquid in the liquid flow channel is heated by heating the common liquid flow channel from the side surface of the case by the heater and, in addition, the liquid in the nozzles can be warmed up by heating the vicinity of the nozzles of the nozzle plate via the head cover in abutment with the heater. Since the void is formed in the area corresponding to the reservoir, heat dissipation from the liquid in the reservoir can be prevented by causing the void to function as the heat insulating layer. Accordingly, the liquid in the liquid ejection head can be heated efficiently, and the viscosity of the liquid to be ejected can be adjusted further adequately. Consequently, the reliability of the liquid ejection head can be enhanced. In addition, since the heater and the heat insulating function can be realized in a simple structure, manufacture is facilitated.

There is also provided a liquid discharging unit including: a flow channel unit including a nozzle plate provided with nozzle rows formed of a plurality of nozzles, and a flow-channel-containing substrate having pressure chambers communicating with the nozzles and a reservoir configured to supply liquid into the pressure chambers and formed on the side of a side surface of the nozzle plate with respect to the nozzle row, the nozzle plate and the flow-channel-containing substrate being laminated, a head case formed with a common liquid flow channel configured to supply the liquid to the reservoir and joined to the flow-channel-containing substrate on the side opposite from the nozzle plate; a heater configured to heat the nozzle plate; a head cover heated by the heater and formed with a bottom surface portion opposing the nozzle plate on the side opposite from the head case, wherein a distal end of the head cover comes into abutment with a portion between an area of the nozzle plate corresponding to the reservoir and an area formed with the nozzle row, and a heat insulating material is formed between the area of the nozzle plate corresponding to the reservoir and the head cover.

In this configuration, since the heat insulating material is provided in the area corresponding to the reservoir, heat dissipation of the liquid in the reservoir can reliably be prevented.

Preferably, a sealing material which prevents communication between the void with the atmospheric air on the outside of the liquid ejection head on the side opposite from the window portion is provided between the head case and the head cover.

In this configuration, since the communication between the void and the atmospheric air is prevented, the heat of the reservoir is prevented from escaping into the atmospheric air via the void, so that the heat dissipation of the liquid in the reservoir can reliably be prevented.

BRIEF DESCRIPTION OF THE DRAWINGS

The invention will be described with reference to the accompanying drawings wherein like numbers reference like elements.

DESCRIPTION OF EXEMPLARY EMBODIMENTS

Figure 1:
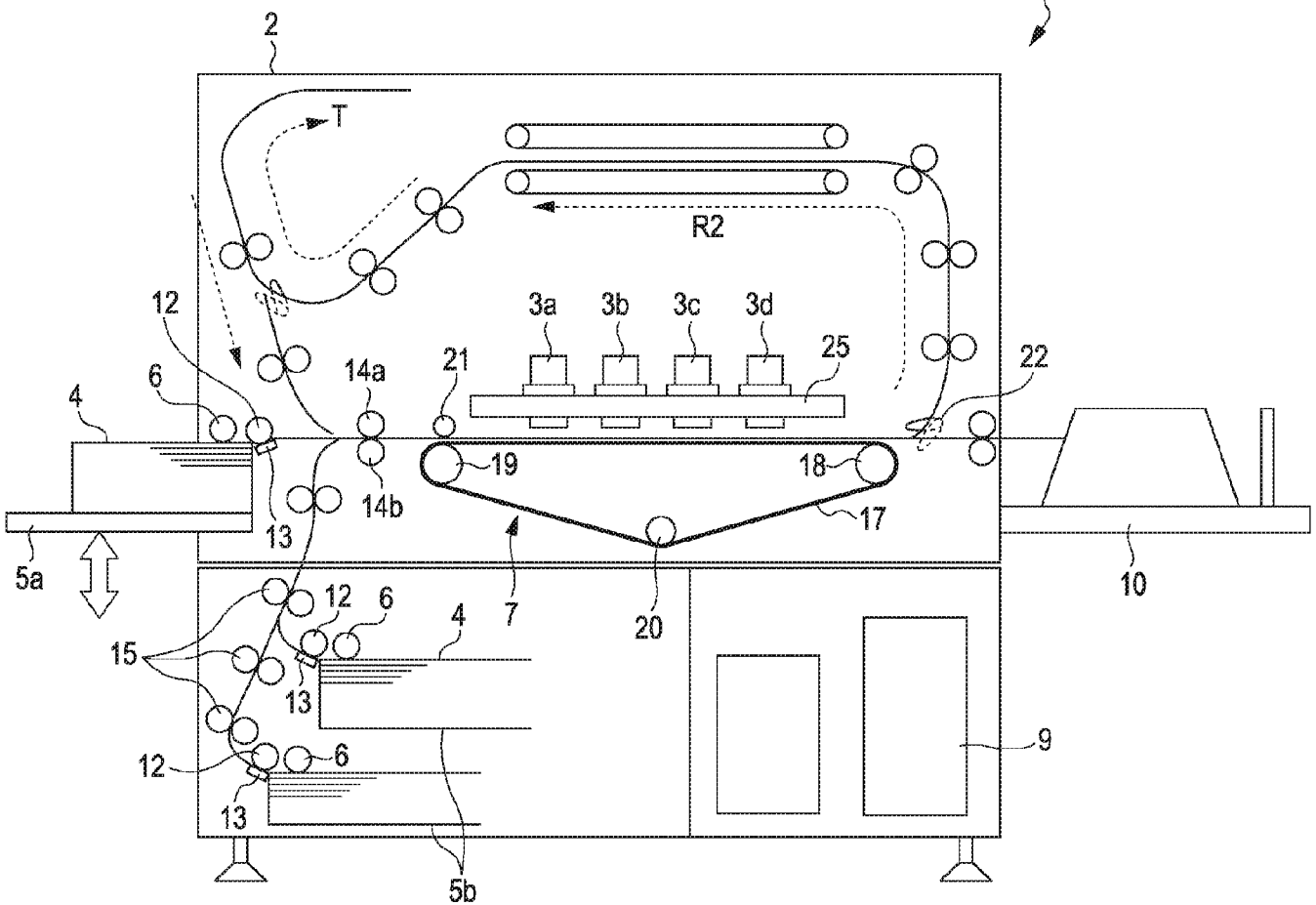
FIG. 1 is a cross-sectional view for explaining a configuration of a printer.

Referring now to the drawings, best modes for carrying out the invention will be described below. In the embodiments described below, various limitations are given as preferable examples of the invention. However, the scope of the invention is not limited thereto unless otherwise stated. In this embodiment, an image recording apparatus as a mode of a liquid ejection apparatus, more specifically, an ink jet printer (hereinafter, referred to simply as "printer") including an elongated liquid ejection head (hereinafter, referred to as "recording head") formed with nozzle opening groups arranged in a length corresponding to a maximum recording width of a recording paper as an object of ejection (or recording medium) at regular intervals will be described as an example.

Figure 2:
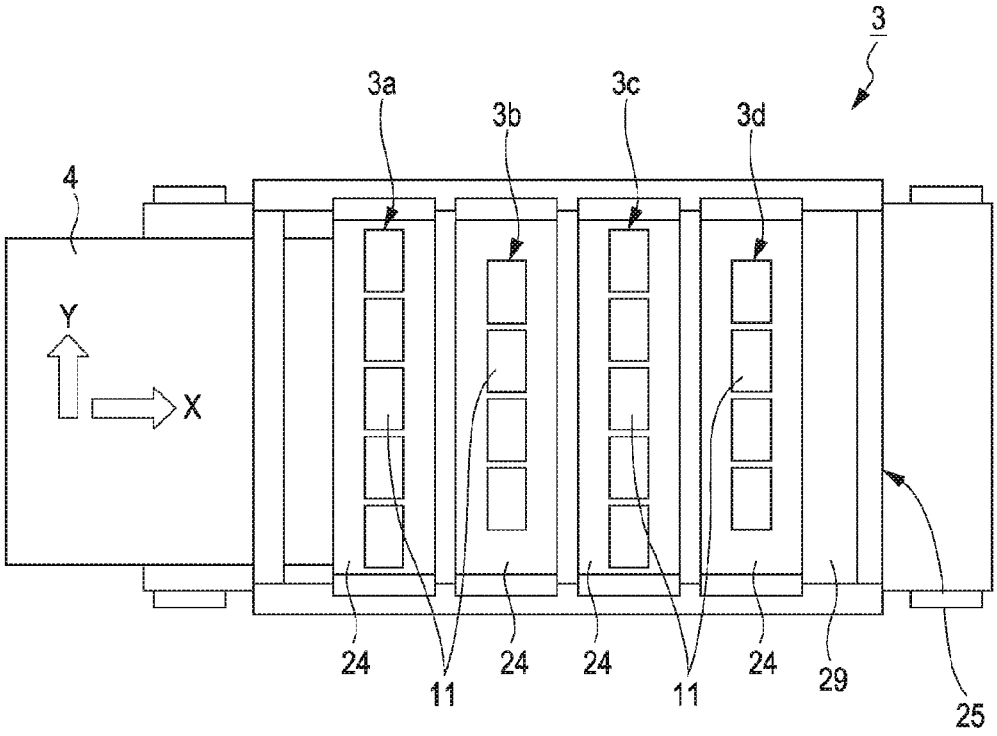
FIG. 2 is a plan view showing a configuration of a head module.

FIG. 1 is a cross-sectional view for explaining a schematic configuration of a printer 1 according to an embodiment of the invention. FIG. 2 is a plan view showing a periphery of a head module 3 in the printer 1. The printer 1 in the embodiment includes the head module 3 as a recording head including a plurality of unit heads 11 arranged in the direction orthogonal to the direction of transport (relative feeding direction, hereinafter, referred to as "first direction X") of a recording paper 4 (a kind of the object of ejection) by a transporting unit 7, a paper feeder 5 including a paper feed tray 5*a* configured to accommodate the recording papers 4 in a stacked state and a lower paper feeding cassette 5*b* provided in the lower portion of the apparatus, the transporting unit 7 configured to allow the recording paper 4 fed from the paper feeders 5*a* and 5*b* to pass under the head module 3 and transport the recording paper 4 toward a paper discharge tray 10, and the paper discharge tray 10 configured to hold the recording paper 4 subjected to recording by the head module 3 and discharged from the transporting unit 7 side, so that the text or images can be recorded over the entire width of the recording area of the recording paper 4 without causing the head module 3 to scan in the first direction X.

Provided in the interior of a housing 2 is a printer controller 9 configured to electrically control respective components. The printer controller 9 includes a drive signal generating circuit (not shown), and outputs a drive signal from the drive signal generating circuit to the respective unit heads 11 via signal cables. Furthermore, although not shown, ink cartridges (liquid supply sources) containing ink (a kind of liquid in the embodiment of the invention) stored therein are arranged in the interior of the housing 2. Ink stored in the cartridge is supplied (pumped) to the respective unit heads 11 of the head module 3 via ink supply tubes by pressurization of the interior of the ink cartridge using an air pump or the like. A configuration in which recording is performed while causing the head module 3 to scan in the first direction X with respect to the recording paper 4 may be employed.

The paper feed tray 5*a* is configured to be movable in the vertical direction, and the position in the vertical direction with respect to the housing 2 is controlled so that the upper surface of the bundle of recording papers (the upper surface of the topmost recording paper 4) comes into abutment with a pickup roller 6 always at a constant pressure. Then, according to the timing of execution of the recording operation by the head module 3, the recording paper 4 is pulled out by the pickup roller 6 from the topmost of the bundle of recording papers, is separated by a separating roller 12 and a separating pad 13 to pieces, and is fed toward downstream. The recording paper 4 passes between paper sensors, not shown, and then comes into abutment with a nip portion of a pair of upper and lower registration roller 14*a* and 14*b*. The recording paper 4 from the lower paper feeding cassette 5*b* reaches the nip portion between the registration roller 14*a* and 14*b* after having passed through a plurality of intermediate rollers 15. Accordingly, the position of a leading edge is aligned, and the skew of the recording paper 4 is corrected. Subsequently, the registration roller 14*a* and 14*b* feed the recording paper 4 in a state of nipping one by one toward the transporting unit 7 at a predetermined timing, and release the nipped state after the recording paper 4 has reached a transporting belt 17 of the transporting unit 7 at a predetermined timing.

The transporting unit 7 includes a drive roller 18 driven by a drive force of a drive motor, not shown, a driven roller 19 disposed on the upstream side of the drive roller 18, the endless transporting belt 17 entrained about the drive roller 18 and the driven roller 19, a tension roller 20 configured to apply a tensile force to the transporting belt 17, and a holding roller 21. The tension roller 20 is disposed between the drive roller 18 and the driven roller 19, and comes into abutment with the transporting belt 17 from inside, and applies a tensile force to the transporting belt 17 by an urging force of an urging member such as a spring. The holding roller 21 is disposed right above the driven roller 19 with the intermediary of the transporting belt 17 therebetween, presses the recording paper 4 on the transfer belt toward the transporting belt 17, and enhances the adhesion of the recording paper 4 with respect to the transporting belt 17.

The drive roller 18 rotates the transporting belt 17 by being driven synchronously with the recording operation of the head module 3, causes the recording paper 4 to pass under the head module 3, and transports the recording paper 4 to the downstream side. The amount of rotation of the transporting belt 17 is detected by an encoder. The detection signals from the encoder are output to the printer controller 9 as encoder pulses.

When performing recording only on one side of the recording paper 4, the recording paper 4 is discharged from the transporting unit 7 to the paper discharge tray 10 after having finished the recording on the one side. In contrast, when performing the recording on both sides of the recording paper 4, the recording paper 4 is transported to a paper inverting route R2 by a flapper 22 disposed downstream of the transporting unit 7 after having finished the recording on one side. After the recording paper 4 has reached a U-turn portion T of the paper inverting route, the direction of transport is redirected. Then, the recording paper 4 is fed again from the registration roller 14*a* and 14*b* to the transporting belt 17 in sequence. After having finished the recording on the other side of the recording paper 4, the recording paper 4 is discharged from the transporting unit 7 to the paper discharge tray 10.

The head module 3 is configured to have a plurality of the unit heads 11 arranged on the head holder 24 in the second direction Y as shown in FIG. 2. A plurality of head modules 3, that is, four head modules 3*a* to 3*d* in this embodiment are attached to a module mounting frame 25 at regular intervals in the first direction X in a state in which the longitudinal direction of the head is aligned with the second direction Y.

Figure 3:
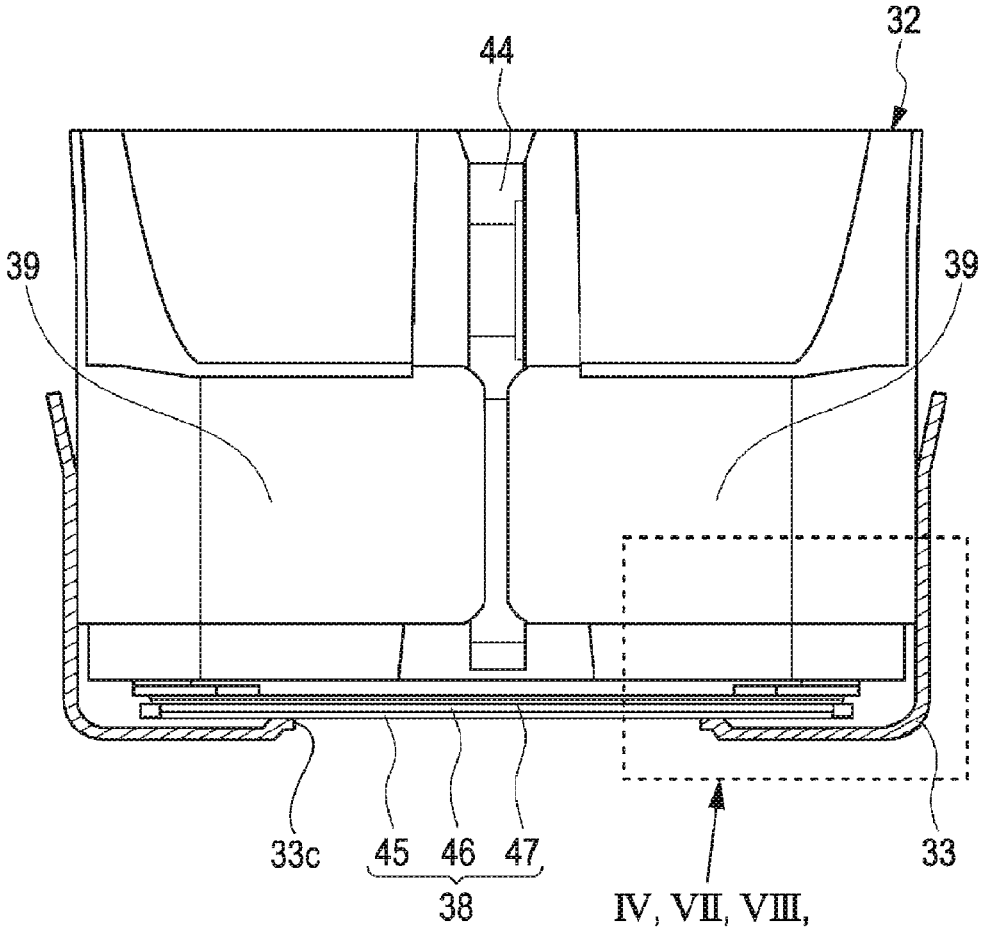
FIG. 3 is a front view for explaining a configuration of a unit head.
Figure 4:
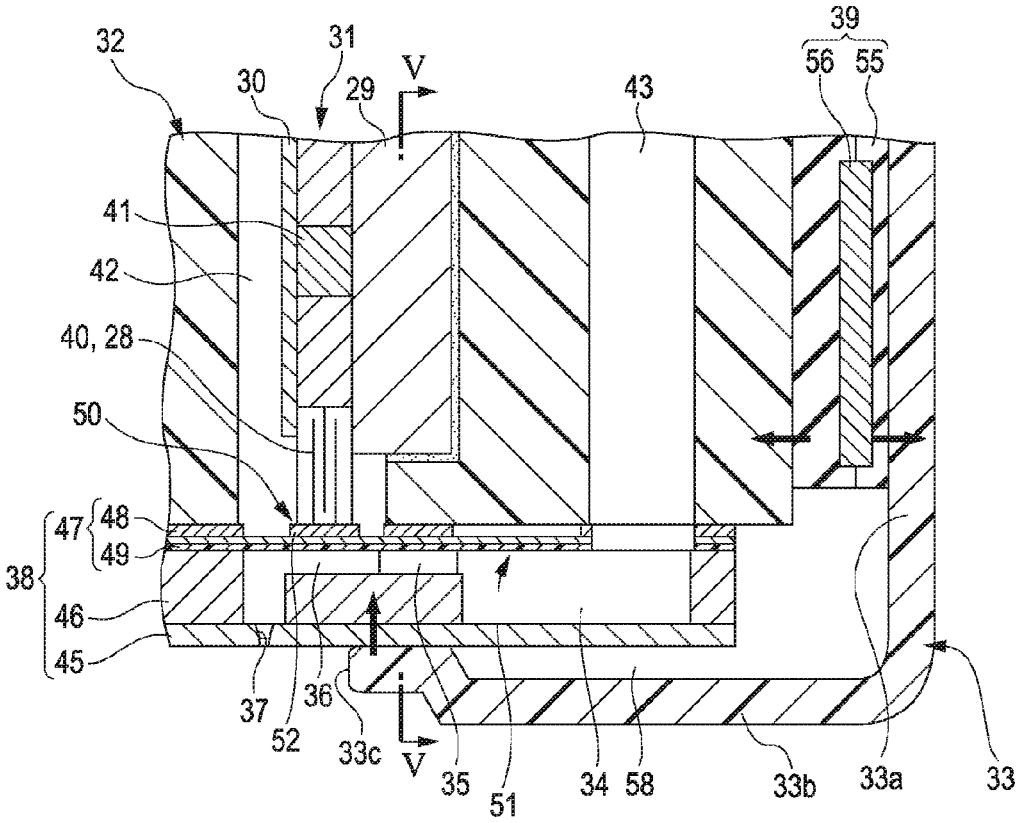
FIG. 4 is an enlarged cross-sectional view of an area IV in FIG. 3.
Figure 5:
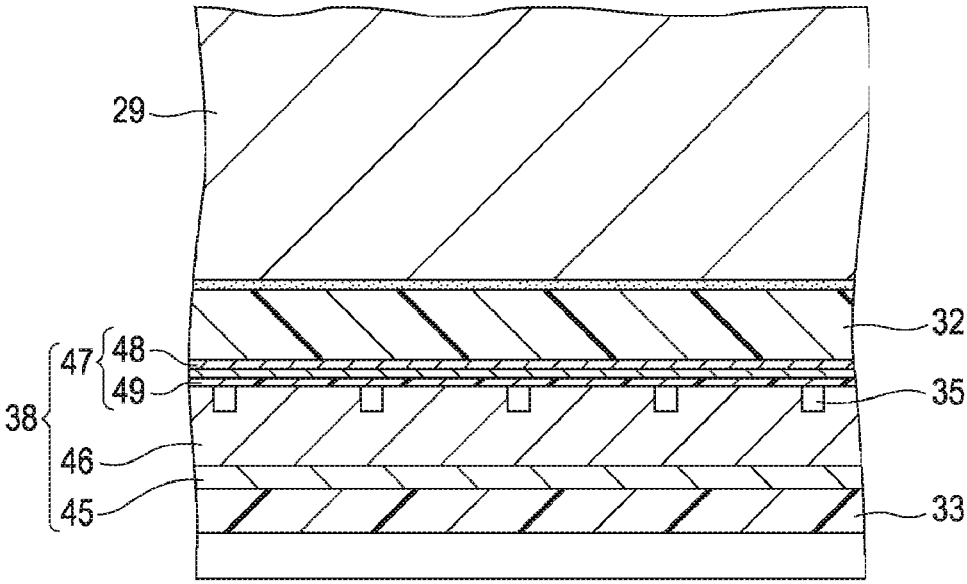
FIG. 5 is a cross-sectional view taken along the line V-V in FIG. 4.

FIG. 3 is a front view for explaining the configuration of the unit head 11, FIG. 4 is a cross-sectional view of an area IV surrounded by a broken line in FIG. 3, and FIG. 5 is a cross-sectional view taken along the line V-V in FIG. 4. The unit head 11 in this embodiment includes a transducer unit 31 including a piezoelectric transducer group 28, a fixing plate 29, and a flexible cable 30 as a unit, a head case 32 which allows storage of the transducer unit 31 therein, a flow channel unit 38 forming a consecutive ink flow channel extending from a reservoir (also referred to as common liquid chamber or manifold) 34 through a pressure chamber 36 to a nozzle 37, a heater 39 arranged on the side surface of the head case 32, and a head cover 33 to be attached to the distal end side of the head case 32 in a state of covering edge portions and side surfaces of the flow channel unit 38.

First of all, the transducer unit 31 will be described. A piezoelectric transducer (a kind of pressure generating element) 40 which constitute the piezoelectric transducer group 28 is formed into a column teeth shape elongated in the vertical direction, and is cut and divided into extremely narrow widths on the order of several tens of μm. The piezoelectric transducers 40 are then configured as vertically oscillating piezoelectric transducers which are expandable in the vertical direction. The piezoelectric transducers 40 are each fixed in a state in which a fixed end is joined onto the fixing plate 29 and a free end thereof projects outward from a distal end edge of the fixing plate 29, that is, in a cantilevered state. Then, the distal ends of the free ends of the piezoelectric transducers 40 are respectively joined to island portions 52 which constitute diaphragm portions 50 in the flow channel unit 38 as described later. The flexible cable 30 is electrically connected to the piezoelectric transducers 40 on a side surface of the fixed end, which is the opposite side from the fixing plate 29. On the surface of the flexible cable 30, a control IC 41 for controlling drive of the respective piezoelectric transducers 40 is packaged. The fixing plate 29 which supports the respective piezoelectric transducers 40 is formed of a metallic panel member having enough rigidity to receive the reaction force from the piezoelectric transducers 40. In this embodiment, the fixing plate 29 is formed of a stainless steel plate having a thickness of approximately 1 mm.

The head case 32 is a hollow box-shaped member formed of resin such as epoxy resin, includes the flow channel unit 38 fixed to a distal end surface (lower surface) and the transducer unit 31 which is a kind of the actuator stored in a storage space 42 formed in the interior of the case. In the interior of the head case 32, a case flow channel 43 (which corresponds to a common liquid flow channel in the invention) is formed so as to penetrate therethrough in the height direction. The case flow channel 43 is a flow channel for supplying ink from the ink cartridge side to the reservoir 34.

Furthermore, in the interior of the head case 32 in this embodiment, more specifically, in the interior of the partitioning wall which defines the storage space 42, a fixture 44 is fixed by insert molding in a state in which the both end portions thereof in the longitudinal direction are exposed outward as a reinforcing core member of the partitioning wall as shown in FIG. 3. The fixture 44 is formed of a metallic member such as stainless (SUS), and is arranged so as to extend in the direction of the height of the head case 32.

Subsequently, the flow channel unit 38 will be described. The flow channel unit 38 includes a nozzle plate 45, a flow-channel-containing substrate 46, and a diaphragm 47, and the diaphragm 47 on the opposite side from the nozzle plate 45 is joined to the head case 32. In this embodiment, as shown in FIG. 4, the flow channel unit 38 is smaller than the head case 32, and is joined inside the outer peripheral edge of the head case 32. Then, the flow channel unit 38 is formed by arranging and laminating the nozzle plate 45 on one of the surfaces of the flow-channel-containing substrate 46 and the diaphragm 47 on the other surface of the flow-channel-containing substrate 46 on the opposite side from the nozzle plate 45 respectively, and integrating the same by adhesion or the like.

The nozzle plate 45 is a thin plate formed of stainless steel formed with a plurality of the nozzles 37 in a row at pitches corresponding to the density of dot formation. In this embodiment, for example, 180 nozzles 37 are formed in a row, and the nozzles 37 constitute a nozzle row. Then two of the nozzle rows are arranged side by side.

The flow-channel-containing substrate 46 is a panel-shaped member formed with a consecutive ink flow channel including the reservoir 34, ink supply ports 35, and the pressure chambers 36. More specifically, the flow-channel-containing substrate 46 is a plate-shaped member including a plurality of void portions, which serve as the pressure chambers 36 corresponding to the respective nozzle 37, in a state of being partitioned by the diaphragms, and void portions which serve as the ink supply ports 35 and the reservoir 34. The flow-channel-containing substrate 46 in this embodiment is manufactured by etching the silicon wafer. The pressure chambers 36 are formed as chambers elongated in the direction orthogonal to the direction of arrangement of the nozzle 37 (the direction of the nozzle row), and the ink supply ports 35 are formed as narrowed portions having a narrow flow channel width communicating the pressure chambers 36 and the reservoir 34. The reservoir 34 is a chamber for supplying ink stored in the ink cartridge to the respective pressure chambers 36 and is communicated with the respective pressure chamber 36 corresponding thereto via the ink supply ports 35.

The diaphragm 47 is a double structure composite panel member formed by laminating a resin film 49 such as PPS (polyphenylene sulfide) on a supporting panel 48 formed of metal such as stainless steel, including the diaphragm portions 50 for sealing one of opening surfaces of the pressure chambers 36 to vary the volumes of the pressure chambers 36 and being formed with compliance portions 51 for sealing one of opening surface of the reservoir 34. Then, the diaphragm portions 50 are formed by etching the supporting panel 48 at portions corresponding to the pressure chambers 36, removing the corresponding portions in an annular shape, and forming the island portions 52 for joining the distal ends of the free end portions of the piezoelectric transducers 40. The island portions 52 have a block shape elongated in the direction orthogonal to the direction of arrangement of the rows of the nozzle 37 like the shape of the pressure chamber 36 in plan view, and portions of the resin film 49 around the island portions 52 function as an elastic film. At the portion which functions as the compliance portion 51, that is, the portion corresponding to the reservoir 34, the supporting panel 48 is removed by etching along the opening shape of the reservoir 34, and hence only the resin film 49 exists.

Since the distal end surfaces of the piezoelectric transducers 40 are joined to the island portions 52, the volumes of the pressure chambers 36 can be varied by expanding and contracting the free end portions of the piezoelectric transducers 40. Ink in the pressure chambers 36 is subjected to the pressure variations in association with the volume variations. Then the respective unit heads 11 which constitute the head module 3 eject (discharge) ink droplets from the nozzle 37 using these pressure variations.

Figure 6:
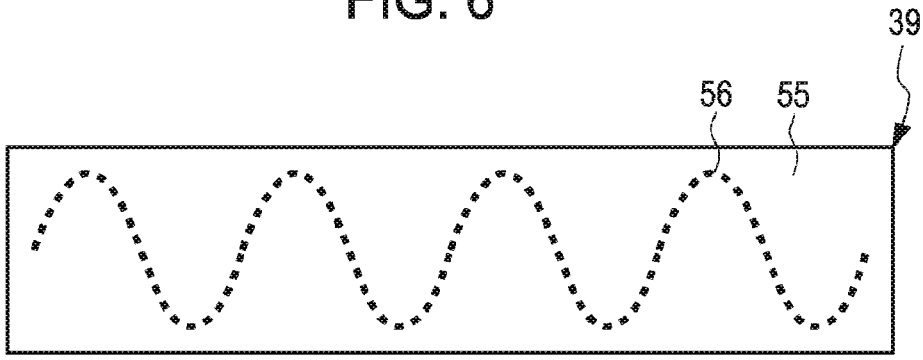
FIG. 6 is a plan view for explaining a configuration of a heater.

Subsequently, the heater 39 will be described. The heater 39 is mounted on the head case 32 so as to cover the outer peripheral surface thereof in a tight-contact manner by being attached to the outer peripheral surface of the head case 32 in a state of partly overlapped in contact with the exposed surface of the fixture 44. As shown in FIG. 4, part of the head cover 33 described later comes into abutment with the surface of an insulator 55 positioned on the outside of the heater 39. In this manner, the heater 39 is arranged between the side surface of the head case 32 and the head cover 33 in a state of being in contact with the both. The heater 39 here is so-called a film heater formed by sealing heating wire 56 such as nichrome wire by a flexible band-shaped insulator 55 as shown in FIG. 6. The heating wire 56 is covered on the surfaces thereof with the insulator 55, and arranged so as to meander equidistantly within the width of the insulator 55, and generates heat by electric current flowing therein.

The head cover 33 is formed, for example, of a metallic thin plate member, includes a side surface potion 33*a* opposing the side surface of the head case 32 and a bottom surface portion 33*b* continuing from the side surface potion 33*a*, being bent at substantially 90 degrees toward the nozzle plate, and opposing the nozzle plate 45 on the opposite side from the head case 32, and is formed so as to cover the peripheral edge of the flow channel unit 38. Therefore, the edge portions of the flow channel unit 38 and the head case 32 are protected by being surrounded by the side surface potion 33*a* and the bottom surface portion 33*b* of the head cover 33. The bottom surface portion 33*b* is formed with a window portion 33*c* so that the nozzles 37 of the nozzle plate 45 are exposed. The distal end of the opening edge of the window portion 33*c* (the inner distal end portion of the bottom surface portion 33*b*) is bent and extended obliquely toward the nozzle plate from the position corresponding to the vicinity of the boundary between the reservoir 34 and the ink supply ports 35, and is bent again at a position coming into contact with the nozzle plate 45 so as to extend parallel to the bottom surface of the nozzle plate 45, and extend to a position close to the nozzle 37 (the position corresponding to the vicinity of the boundary between the ink supply ports 35 and the pressure chambers 36 in this embodiment) to an extent not being overlapped with the nozzle 37 as shown in FIG. 4. Then, as shown in FIGS. 4 and 5, since the distal end of the opening edge of the window portion 33*c* comes into abutment with the nozzle plate 45 at the portion between the area corresponding to the reservoir 34 and the nozzle 37, a void 58 is formed between the nozzle plate 45 and the bottom surface portion 33*b*, which corresponds to the reservoir 34. The void 58 functions as a heat insulating layer. In contrast, the side surface potion 33*a* holds the heater 39 in cooperation with the head case 32 and, as described above, pat of the side surface potion 33*a* is in abutment with the insulator 55 of the heater 39. Therefore, heat from the heater 39 can be transferred to the head cover 33. The head cover 33 can prevent electrostatic charge of the nozzle plate 45 by being connected to the ground.

Subsequently, transfer of heat by passing electric current through the heater 39 will be described. First of all, by passing the electric flow in the heating wire 56 of the heater 39, the heater 39 generates heat. Then, the heat of the heater 39 is transferred to the side surface of the head case 32 which comes into contact with the heater 39 and the fixture 44 embedded in the head case 32, and transferred to a portion of the side surface potion 33*a* of the head cover 33 coming into abutment with the heater 39. The heat transferred to the head case 32 side is also transferred to the flow channel unit 38 side, thereby heating ink in the case flow channel 43, the reservoir 34, the ink supply ports 35, the pressure chambers 36, and the nozzle 37 (a consecutive liquid flow channel). Here, the void 58 is formed in an area between the nozzle plate 45 and the bottom surface portion 33*b*, and an area corresponding to the reservoir 34, so that air in the void 58 can be functioned as a heat insulating layer. Therefore, heat dissipation from the reservoir 34 having a larger surface area and hence is subjected to heat dissipation in comparison with other liquid flow channels can be prevented. Since the head cover 33 is in contact with the nozzle plate 45 at the portion between an area corresponding to the reservoir 34 and the nozzle 37, the ink in the nozzle 37 can be heated further directly by heat transferred to the head cover 33 is transferred to the nozzle plate 45 and the flow-channel-containing substrate 46 in the vicinity of the nozzle 37, or by heat radiated from the head cover 33 into the atmosphere.

In this manner, both the upstream side and the downstream side of the liquid flow channel in the unit head 11 can be efficiently heated and, in addition, the void 58 between the nozzle plate 45 and the bottom surface portion 33*b* functions as the heat insulating layer to efficiently prevent the heat dissipation from the reservoir 34. Therefore, ink in the unit head 11, in particular, the ink in the vicinity of the nozzle 37 can be heated efficiently. For example, when setting the temperature of the ink in the nozzle 37 to 40 degrees, the temperature of the heater 39 may be set to approximately 40 to 43 degrees. In this setting, the viscosity of the ink can be adjusted to a viscosity suitable for ejection, and the ink discharged from the nozzle 37 due to the pressure variations of the piezoelectric transducer 40 can be discharged by an amount and at a speed as designed. Consequently, the reliability of the unit head 11 (the head module 3) can be enhanced. Also, since the heater 39 is mounted on the side surface of the head case 32 and the head cover 33 is designed in a simple structure as described above, easy manufacture is achieved.

Figure 7:
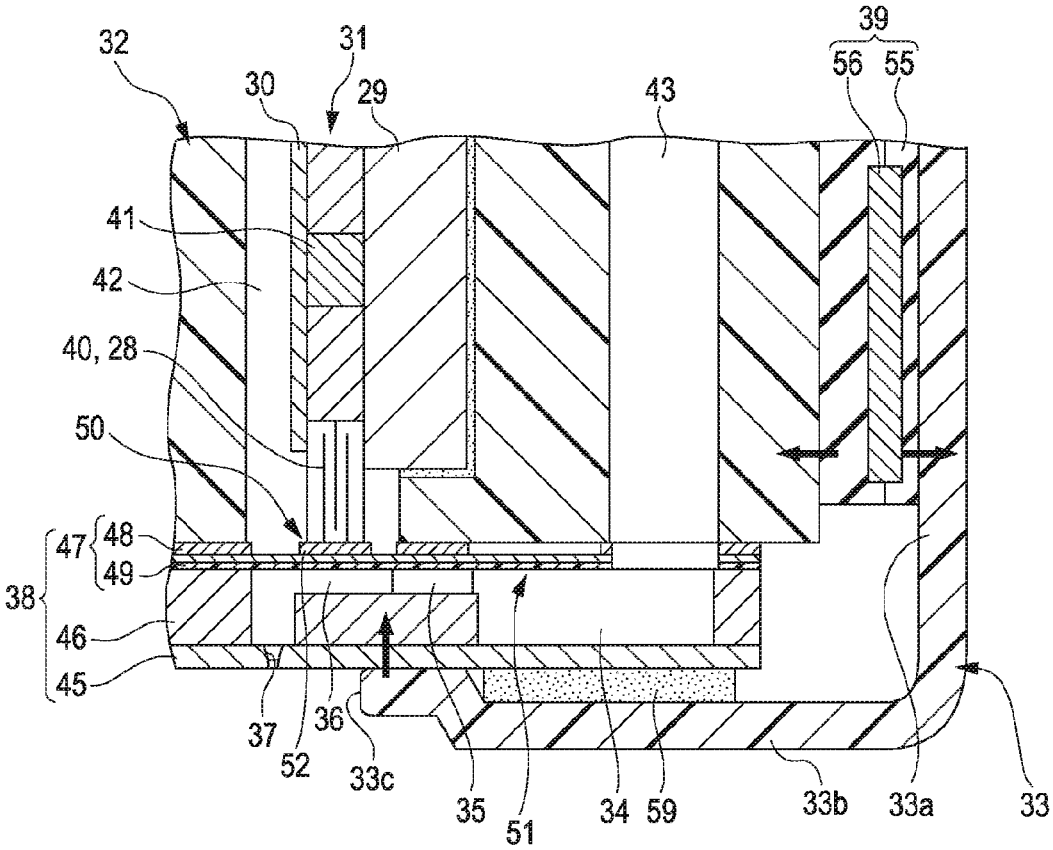
FIG. 7 is an enlarged cross-sectional view of an area VII in FIG. 3 according to a second embodiment.
Figure 8:
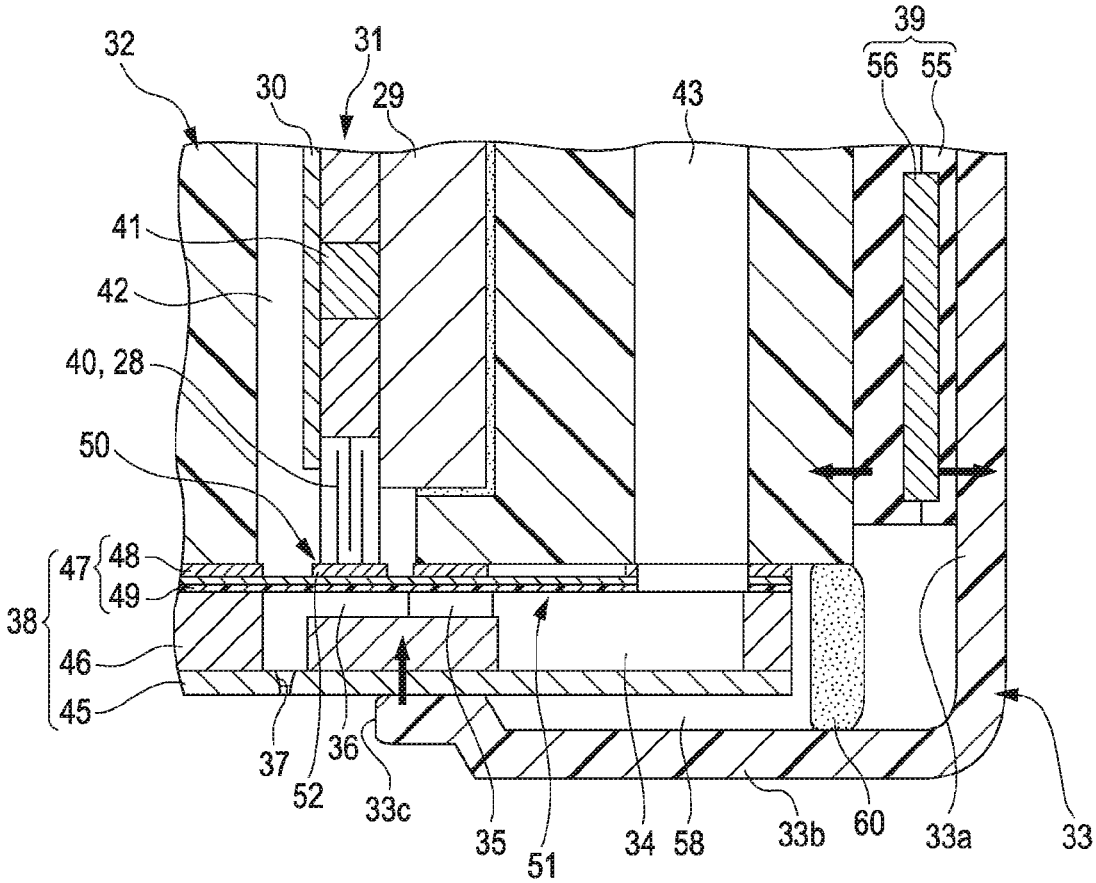
FIG. 8 is an enlarged cross-sectional view of the area VIII in FIG. 3 according to a third embodiment.

The invention is not limited to the first embodiment described above and various modifications may be made on the basis of the description in claims. For example, as other embodiments, FIG. 7 shows a second embodiment and FIG. 8 shows a third embodiment.

The second embodiment will now be described. In the second embodiment, the void 58 is provided between the nozzle plate 45 and the bottom surface portion 33*b*, and a heat insulating material 59 is provided in the void 58 as in the first embodiment. The heat insulating material 59 is a sheet-shaped member covering the nozzle plate 45 in substantially the same area as the area corresponding to the reservoir 34, and members having low coefficient of thermal conductivities (for example, sponge or adhesive agent containing silicone (coefficient of thermal conductivity, approx. 0.16 W/m·K) or epoxy resin (coefficient of thermal conductivity, approx. 0.21 W/m·K) as main component) can be used. The heat insulating material 59 has substantially the same thickness as the thickness of the void 58, and one of the surfaces of the heat insulating material 59 is bonded to the nozzle plate 45, and the other surface is in abutment with the inner surface of the bottom surface portion 33*b* of the head cover 33. Since other configurations are the same as those in the first embodiment, the description will be omitted.

In this manner, when the heat insulating material 59 is provided in the area corresponding to the reservoir 34, the ink in the reservoir 34 is prevented from radiating heat completely, whereby the ink in the unit head 11 can be heated further efficiently. Therefore, the viscosity of the ink can be adjusted to a viscosity suitable for ejection, and the ink discharged from the nozzle 37 due to the pressure variations of the piezoelectric transducer 40 can be discharged by an amount and at a speed as designed, so that the reliability of the unit head 11 (the head module 3) can be enhanced.

The thickness of the heat insulating material 59 here is not limited to the second embodiment and may be thinner than the thickness of the void 58. One of the surfaces of the heat insulating material 59 may be bonded to the nozzle plate 45, thereby forming a void between the other surface and the head cover 33. The size of the heat insulating material 59 with respect to the nozzle plate 45 may be smaller than the area corresponding to the reservoir 34. What is important is that the heat insulating material 59 is provided in the void 58 at least partly in an area corresponding to the reservoir 34.

Subsequently, a third embodiment will be described. In the third embodiment, the point that the void 58 is provided between the nozzle plate 45 and the bottom surface portion 33*b* is the same as the first embodiment. However, the third embodiment is different from the first embodiment in that a sealing material 60 is provided outside the flow channel unit 38 and between the head case 32 and the head cover 33. In the third embodiment, a portion between the bottom surface edge portion of the head case 32 outside the flow channel unit 38 and the bottom surface portion 33*b* of the head cover 33 is sealed by the sealing material 60. Therefore, the void 58 is prevented from communicating with the atmospheric air outside the unit head 11 (the head module 3) on the opposite side from the window portion 33*c* to trap the air, so that the heat in the void 58 can be trapped. Since other configurations are the same as those in the first embodiment, the description will be omitted. In the third embodiment as well, the heat insulating material 59 may be provided in the void 58 as in the second embodiment.

In this manner, by preventing communication between the void 58 and the atmospheric air and trapping the air in the void 58, the heat of the reservoir 34 is prevented from escaping into the atmospheric air via the void 58, so that heat dissipation from the ink in the reservoir 34 is prevented further reliably. Therefore, the viscosity of the ink can be adjusted to a viscosity suitable for ejection, and the ink discharged from the nozzle 37 due to the pressure variations of the piezoelectric transducer 40 can be discharged by an amount and at a speed as designed, so that the reliability of the unit head 11 (the head module 3) can be enhanced. The sealing material 60 described above may be provided in an area between the head case 32 and the head cover 33, and upward of the heater 39 in the vertical direction (opposite side from the bottom surface portion 33*b*). In this configuration, since the void 58 to the portion including the heater 39 can be sealed, the heat is prevented from escaping from the heater 39. Therefore, the heating efficiency with respect to the head components can be improved.

The invention is not limited to the embodiments described above. For example, in the embodiments described above, a configuration in which the fixture 44 is insert-molded in the head case 32 is exemplified. However, the invention is not limited thereto, and the entire head case 32 may be formed of resin or metal. When the entire head case 32 is formed of metal, the heat transfer efficiency of the head case 32 can be enhanced. Also, the configuration in which the head cover 33 is formed of a metallic thin panel member has been described. However, the invention is not limited thereto, and the head cover 33 may be formed of both a resin member and a metallic member. In other words, by configuring at least part of the head case 32 and the head cover 33 with a metallic member, causing the metallic member to come into abutment with the heater 39, and providing the heat insulating function in the area of the nozzle plate 45 corresponding to the reservoir 34, the heat of the heater 39 can be transferred efficiently, and the heat dissipation from the liquid in the reservoir 34 can be prevented.

In the embodiment described above, the piezoelectric transducer 40 of so-called the vertical vibration mode is exemplified as a pressure generating unit. However, the invention is not limited thereto. For example, the invention can be applied to a case where the piezoelectric transducer or a heating element of so-called a flexural vibration mode.

The invention is not limited to the printer, and may also be applied to plotters, facsimile machines, copying machines, various ink jet recording apparatuses, liquid ejection apparatuses other than the recording apparatuses, for example, display manufacturing apparatuses, electrode manufacturing apparatuses, and chip manufacturing apparatuses.

What is claimed is:

1. A liquid ejection head comprising:

a flow channel unit including a nozzle plate provided with nozzle rows formed of a plurality of nozzles, and a flow-channel-containing substrate having pressure chambers communicating with the nozzles and a reservoir configured to supply liquid into the pressure chambers and formed on the side of a side surface of the nozzle plate with respect to the nozzle row, the nozzle plate and the flow-channel-containing substrate being laminated, a head case formed with a common liquid flow channel configured to supply the liquid to the reservoir and joined to the flow-channel-containing substrate on the side opposite from the nozzle plate;

a heater configured to heat the nozzle plate;

a head cover heated by the heater and formed with a bottom surface portion opposing the nozzle plate on the side opposite from the head case, wherein a distal end of the head cover comes into abutment with a portion between an area of the nozzle plate corresponding to the reservoir and an area formed with the nozzle row, and a void is formed between the area of the nozzle plate corresponding to the reservoir and the head cover.

2. The liquid ejection head according to claim 1, wherein a sealing material which prevents communication between the void with the atmospheric air on the outside of the liquid ejection head on the side opposite from a window portion is provided between the head case and the head cover.

3. A liquid ejection head comprising:

a flow channel unit including a nozzle plate provided with nozzle rows formed of a plurality of nozzles, and a flow-channel-containing substrate having pressure chambers communicating with the nozzles and a reservoir configured to supply liquid into the pressure chambers and formed on the side of a side surface of the nozzle plate with respect to the nozzle row, the nozzle plate and the flow-channel-containing substrate being laminated, a head case formed with a common liquid flow channel configured to supply the liquid to the reservoir and joined to the flow-channel-containing substrate on the side opposite from the nozzle plate;

a heater configured to heat the nozzle plate;

a head cover heated by the heater and formed with a bottom surface portion opposing the nozzle plate on the side opposite from the head case, wherein a distal end of the head cover comes into abutment with a portion between an area of the nozzle plate corresponding to the reservoir and an area formed with the nozzle row, and a heat insulating material is provided between the area of the nozzle plate corresponding to the reservoir and the head cover.

* * * * *